US006736562B2

(12) United States Patent
Whitmore

(10) Patent No.: US 6,736,562 B2
(45) Date of Patent: May 18, 2004

(54) MODULAR LIQUID DISPENSER AND APPLICATOR

(76) Inventor: Robert Charles Whitmore, 884 Greenway Rd., Woodbridge, CT (US) 06525

( * ) Notice: Subject to any disclaimer, the term of this patent is extended or adjusted under 35 U.S.C. 154(b) by 65 days.

(21) Appl. No.: 10/270,453

(22) Filed: Oct. 15, 2002

(65) Prior Publication Data

US 2004/0069810 A1 Apr. 15, 2004

(51) Int. Cl.[7] ..... A46B 5/02

(52) U.S. Cl. ..... 401/125; 401/202; 401/203; 401/204; 222/192; 222/321.6; 222/321.9; 222/325

(58) Field of Search ..... 222/162, 192, 222/180, 321.6, 321.9, 205, 325; 401/125, 202–204

(56) References Cited

U.S. PATENT DOCUMENTS

| | | | | | |
|---|---|---|---|---|---|
| 2,752,069 | A | * | 6/1956 | Welsh | 401/125 |
| 4,831,681 | A | | 5/1989 | Puder | |
| 5,507,414 | A | | 4/1996 | Ong | |
| 6,270,275 | B1 | | 8/2001 | Martz | |
| 6,280,111 | B1 | | 8/2001 | Armer et al. | |
| 6,309,124 | B1 | | 10/2001 | Gueret | |
| 6,604,879 | B2 | * | 8/2003 | Gueret | 401/202 |
| 2001/0035429 | A1 | | 11/2001 | Colquhoun | |
| 2002/0071708 | A1 | | 6/2002 | Fontanet | |

* cited by examiner

*Primary Examiner*—Philippe Derakshani

(57) ABSTRACT

A device for storing and applying liquid to a cleaning implement, including an application module which may be slidably engaged to either a countertop reservoir module, or an installed reservoir module.

18 Claims, 6 Drawing Sheets

MODULAR LIQUID DISPENSER AND APPLICATOR

CROSS-REFERENCE TO RELATED APPLICATIONS

Not applicable.

BACKGROUND

1. Field of Invention

This invention relates to liquid soap or lotion dispensers and applicators wherein soap or lotion is dispensed or applied by a manual pump. This invention further relates to soap or lotion dispensers or applicators incorporating means to retain and apply liquid soap to a related cleaning utensil.

2. Description of Prior Art

Liquid soap dispensers are common household items. They are available in either uninstalled "countertop", or installed "thru-counter" configurations. Various soap dispensers provide a housing incorporating support for a cleaning utensil such as a common dish sponge, and also provide a means for application of soap to the cleaning utensil.

U.S. Pat. No. 6,270,275 to Martz (2001), and U.S. Pat. No. 5,507,414 to Ong (1996) teach countertop dispensers wherein liquid is applied to a sponge through a valve controlled, gravity fed system. Valve controlled gravity fed liquid application is not "fail-safe". If the valve means becomes gummed up, leaks, or fails, liquid may flood the sponge support and overflow the contents of the reservoir onto the countertop.

U.S. Pat. No. 6,280,111 to Armer (2001) teaches a countertop dispenser wherein a lever may be actuated to pump liquid soap into an application chamber. Excess soap drains from the application chamber through a plethora of holes. At rest, application chamber is entirely above liquid level in reservoir and exposed to air.

Liquid dishwashing soap when exposed to air, tends to dry out and increase in viscosity, eventually becoming gummy. Continual filling and draining (exposing to air) of application chamber may coat chamber walls and drainage holes with gummy, partially dried soap. This creates an unpreferable condition in the application chamber, and may clog drainage holes entirely.

U.S. Pat. No. 6,309,124 to Gueret (2001) teaches a dispenser wherein preferably a cosmetic or pharmaceutical liquid or gel is pumped from a reservoir into an application chamber. The chamber is sealed by screwing or snapping on a removable cap. The cap comprises the applicator itself. Positioning of the cap relative to the application chamber is required for dispensing liquid or gel to the applicator. This configuration is not preferable for application of liquid dishwashing soap to a kitchen sponge.

A common procedure for using a sponge is to apply a small amount of liquid soap to it, run it under water, then kneed the sponge to a lather. This is done to determine if further application of soap is required to perform the particular cleaning task. This is not practical with the Gueret invention. Common usage of a kitchen sponge requires that it be completely flexible for cleaning contours such as the inside of a drinking glass. Attachment of a sponge to a substantially rigid cap limits its ability to perform most cleaning tasks.

No prior art has been found to meet the need for a device which houses and applies soap to a kitchen sponge, creates a soap pool for dipping fingertips, will not overflow, clog or gum up, and is of a modular configuration wherein an application module may be used interchangeably with either a countertop or installed (below counter) reservoir.

SUMMARY

The present invention fulfills the above needs, providing a modular dispensing and application device which houses and applies liquid soap to a common kitchen sponge, and also creates a liquid soap pool for dipping fingertips to wash hands. Interchangeable reservoirs allow the consumer to utilize the device before incurring the labor or expense of permanent installation.

Objects and Advantages

Accordingly, several objects and advantages of the preferred embodiment of the present invention are:

(a) to create a dispenser for application of liquid dishwashing soap to either a cleaning utensil (sponge), or to fingertips for washing hands.

(b) to be of modular design, allowing the consumer to utilize the present invention as a countertop device before deciding whether or not to install permanently.

(c) to pump soap vertically into a bottom fed pool eliminating gumming or clogging of passageways or orifices due to air exposure.

(d) to supply soap in a fail-safe manor, wherein pump leakage or failure results in soap returning to reservoir. Soap will not flood or overflow application module.

(e) to utilize and work preferentially with a common kitchen sponge. No special applicator need be utilized or re-purchased when original wears out.

Other objects and advantages are:

(f) to accommodate simply controlled, one-handed application of soap to a sponge. Light downward pressure yields incremental dosing.

(g) to apply soap to the central bottom surface of a sponge, soap will not squirt onto hands.

(h) to dispense and/or apply liquid soaps, creams, or disinfectant solutions of a wide viscosity range.

(i) to impregnate liquid soap into a sponge without excessively back-pressuring the supply pump.

(j) to utilize an easily replaceable common lotion pump, whereby no tools are required for replacement.

(k) to be easily refillable. Application module slides off either countertop or installed reservoir modules, exposing an orifice to pour in liquid.

(l) to be stable in operation. Countertop reservoir module incorporates an elastomeric base ring, increasing stability and eliminating slippage across countertop.

(m) to require a small "footprint" of countertop space, not much larger than a sponge itself.

(n) to be manufactured largely of translucent plastic, allowing light to permeate from all sides to reduce bacterial growth. This also allows color of sponge and soap to show through and accent kitchen or bath decor.

Further objects and advantages of the present invention will become apparent from a consideration of the drawings and ensuing description.

DRAWING FIGURES

For a fuller understanding of the nature and objects of the present invention, reference should be had to the following detailed description taken in connection with the accompanying drawings in which.

REFERENCE NUMERALS IN DRAWINGS

Preferred Embodiment: FIGS. 1–5

| | | | |
|---|---|---|---|
| 20 | application module | 22 | countertop reservoir module |
| 24 | installed reservoir module | 26 | cleaning implement housing |
| 28 | application module engagement cyclinder | 30 | implement support tray |
| 32 | lid | 34 | implement chamber |
| 36 | hinges | 38 | lid stop blocks |
| 40 | fingertab | 42 | application well |
| 44 | dispersion orifices | 46 | dispersion chamber |
| 48 | pump seal | 50 | seal ledge |
| 52 | pump seal flange | 54 | pump seal tube |
| 56 | liquid pump output tube | 58 | liquid pump |
| 60 | application well side wall | 62 | application well base |
| 64 | application well fillet | 66 | reservoir cap |
| 68 | countertop reservoir | 70 | elastomeric base ring |
| 72 | cap engagement cylinder | 74 | liquid pump flange |
| 76 | cap landing | 78 | cylinder inner flange |
| 80 | cap drainage slots | 82 | support tube |
| 84 | counter flange | 86 | elastomeric washer |
| 88 | plain washer | 90 | retention nut |
| 92 | installed reservoir | 94 | extension tube |
| 96 | support tube engagement cyclinder | 98 | support tube landing |
| 100 | support tube undercut | 102 | counter flange undercut |
| 104 | support tube external threads | 106 | support tube internal threads |
| 108 | cleaning implement (prior art) | | |

Figure 6:
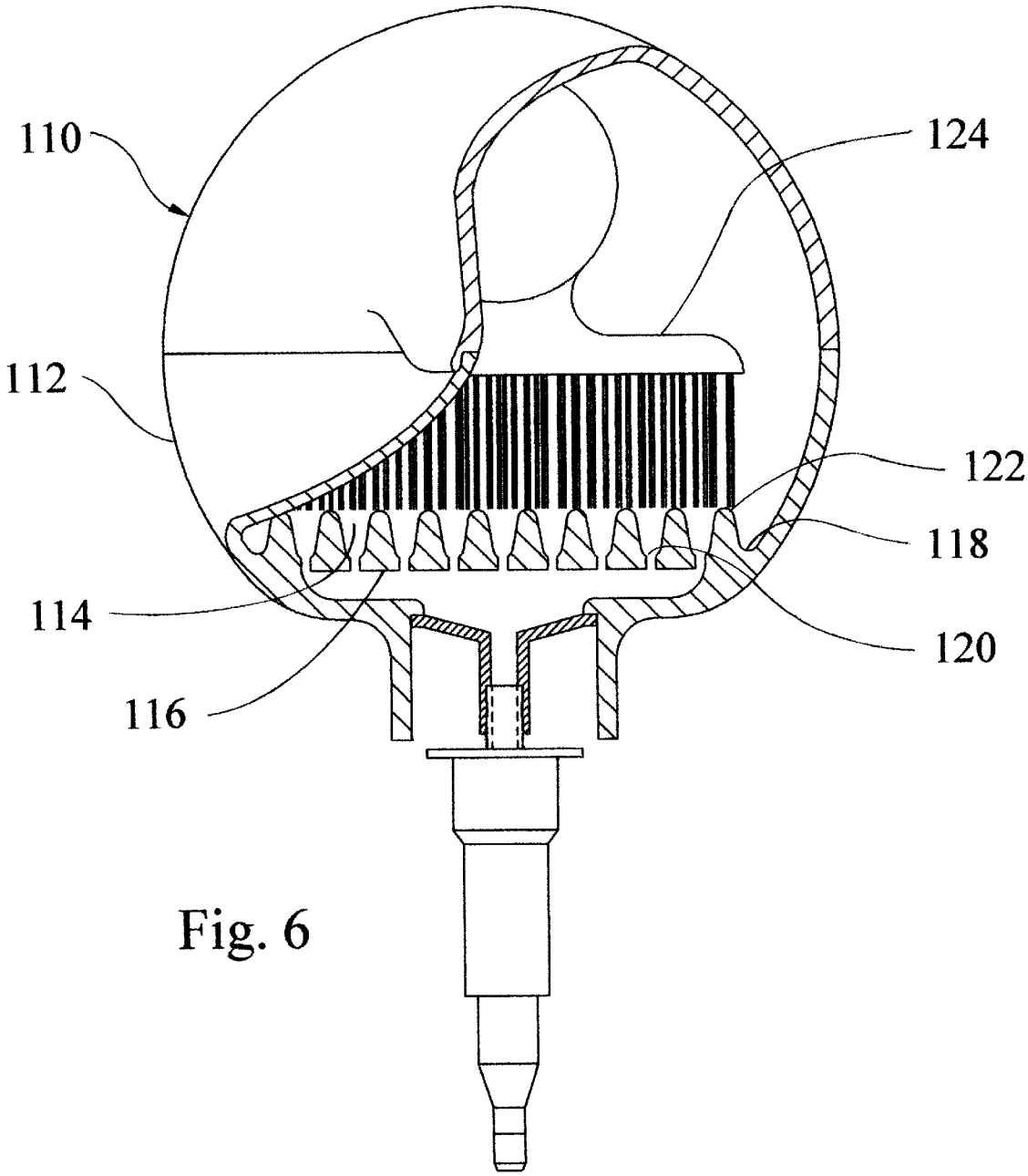
FIG. 6 is a front partially sectional view of an alternate application module of a liquid dispenser and applicator of the present invention.

(Alternate Embodiment: FIG. 6)

| | | | |
|---|---|---|---|
| 110 | alternate application module | 112 | brush housing |
| 114 | brush application well | 116 | brush application well base |
| 118 | perimeter convolution valley | 120 | convolution valleys |
| 122 | convolution peaks | 124 | cleaning brush (prior art) |

Description—FIGS. 1–5—Preferred Embodiment

In FIGS. 1–5 the preferred embodiments of a modular liquid dispenser and applicator of the present invention are depicted. By referring to these drawings, along with the following detailed disclosure, the construction and operation of the present invention can best be understood. However, it is also to be understood that the present invention can be employed in alternate configurations not depicted herein. The following detailed disclosure as well as the associated drawings are provided for explanatory purposes and are not intended to limit the scope of the present invention.

Figure 1:
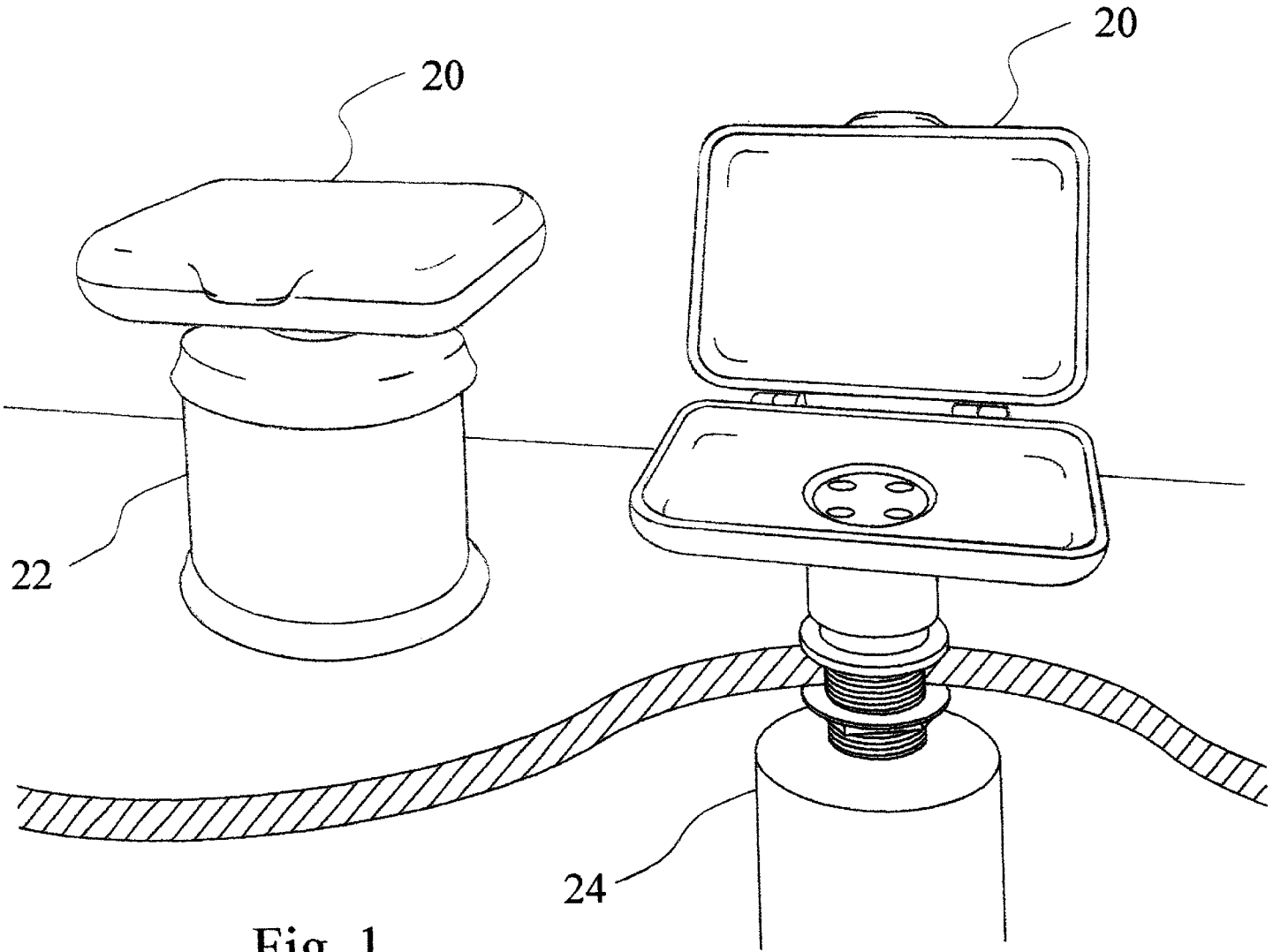
FIG. 1 is a perspective view of the preferred embodiments of a modular liquid dispenser and applicator of the present invention.

As shown in FIG. 1, a preferred embodiment of a modular liquid dispenser and applicator of the present invention comprises an application module 20 which may be slidably received by either a countertop reservoir module 22, or an installed reservoir module 24. All components are preferably molded of transluscent plastic.

Figure 2:
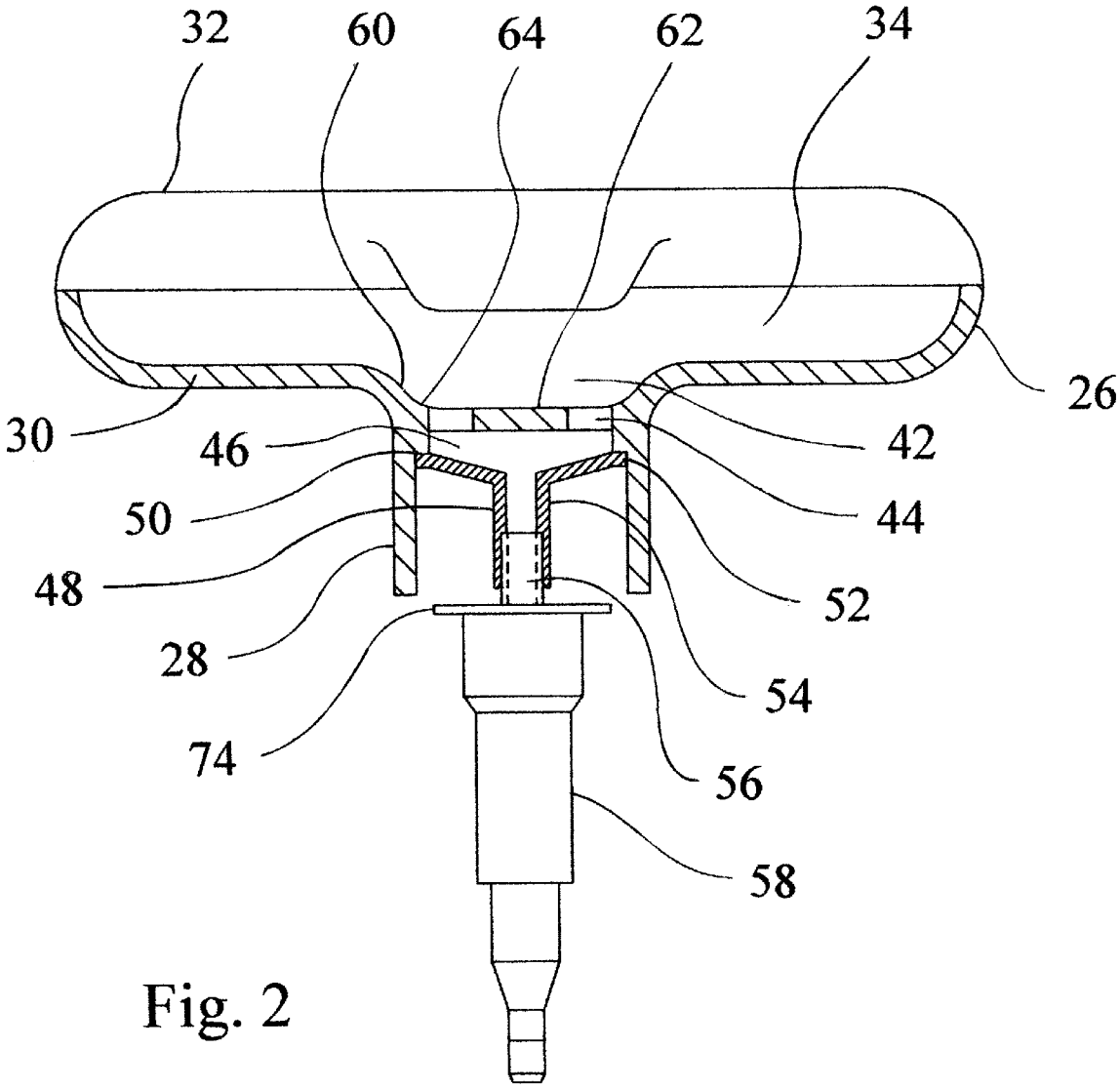
FIG. 2 is a front partially sectional view of an application module of a modular liquid dispenser and applicator of the present invention.
Figure 3:
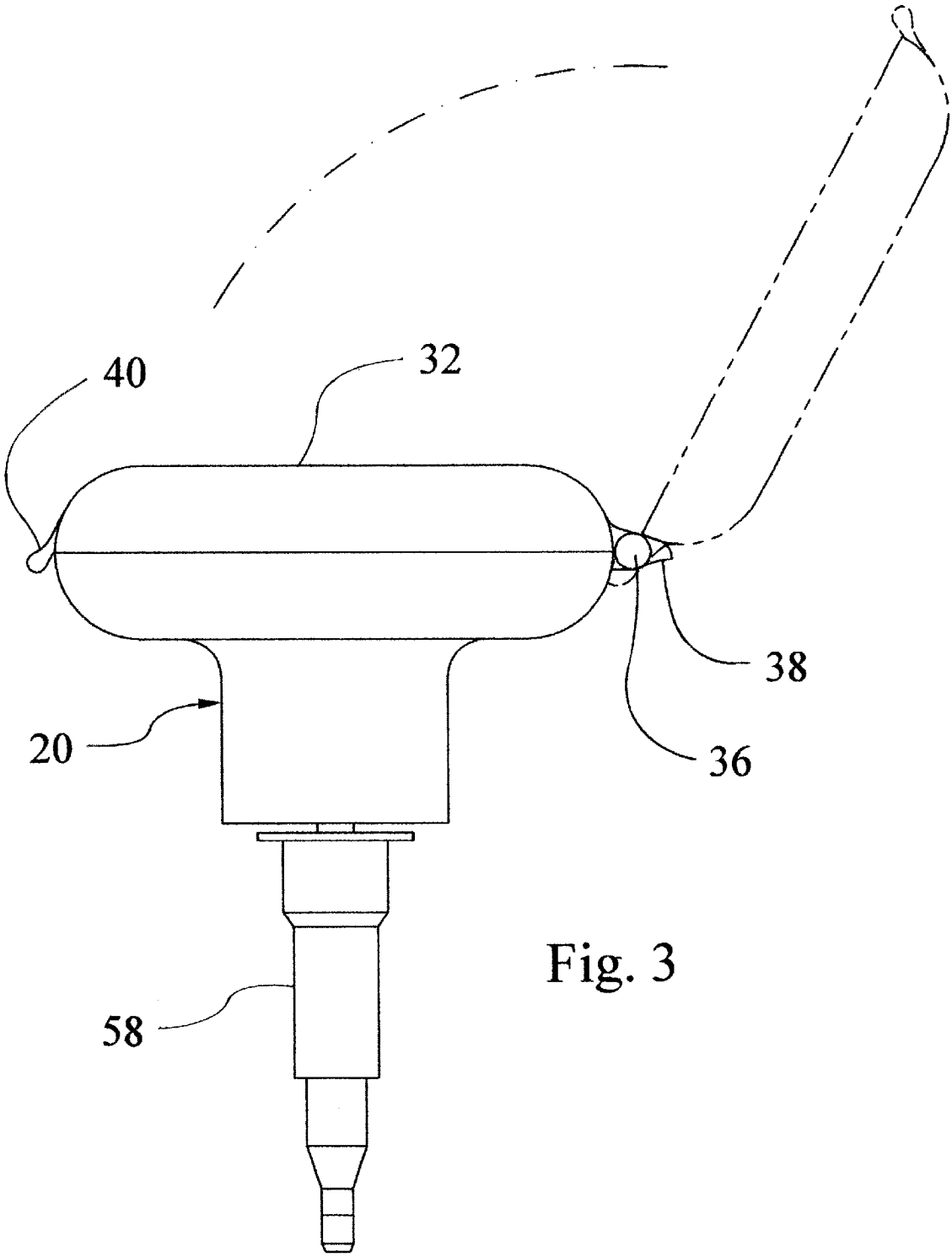
FIG. 3 is a side view of an application module of a modular liquid dispenser and applicator of the present invention.

As shown in FIGS. 2 and 3, a preferred embodiment of an application module 20 comprises a cleaning implement housing 26 supported by an integral application module engagement cylinder 28. Cleaning implement housing 26 consists of an implement support tray 30 and a lid 32 whereby closure of lid 32 creates a substantially sealed implement chamber 34. Hinges 36 are preferably of peg and socket type molded in unitary construction with lid 32, and implement support tray 30. Lid stop blocks 38 extend from hinges 36 on lid 32. Lid stop blocks 38 restrict opening of lid to approximately 120 degrees at which point they contact implement support tray 30. Protruding from lid 32 opposite hinges 36, is finger tab 40 allowing hinged lid 32 to be easily opened. Opening lid 32 allows access to a cleaning implement 108 (preferably a sponge) which may be supported on implement support tray 30 within implement chamber 34.

Implement support tray 30 comprises a centrally positioned depressed area creating application well 42. Application well 42 comprises application well base 62 which is perforated by multiple dispersion orifices 44 located around its periphery. Positioned adjacent to application well base 62, application well fillet 64 and application well sidewall 60 complete the aforementioned application well 42.

Pump seal 48 is configured as a flanged tube. Periphery of pump seal flange 52 is permanently bonded or otherwise attached to implement support tray 30 at seal ledge 50 creating dispersion chamber 46. Dispersion orifices 44 transgress between application well base 62 and dispersion chamber 46 and are positioned so as to not allow direct in-line flow of liquid through dispersion chamber. Pump seal tube 54 is configured so as to removably retain liquid pump output tube 56 preferably by snap-fit. Downward force exerted upon liquid pump output tube may actuate liquid pump 58. Length of pump seal tube 54 determines the actuation stroke length of liquid pump 58 and therefore the volume of liquid dispensed per actuation. Liquid pump, pump seal, dispersion chamber, and dispersion orifices are sized and configured so as to allow pump-forced flow of liquids (from approximately 1 to 10,000 centipoises).

Figure 4:
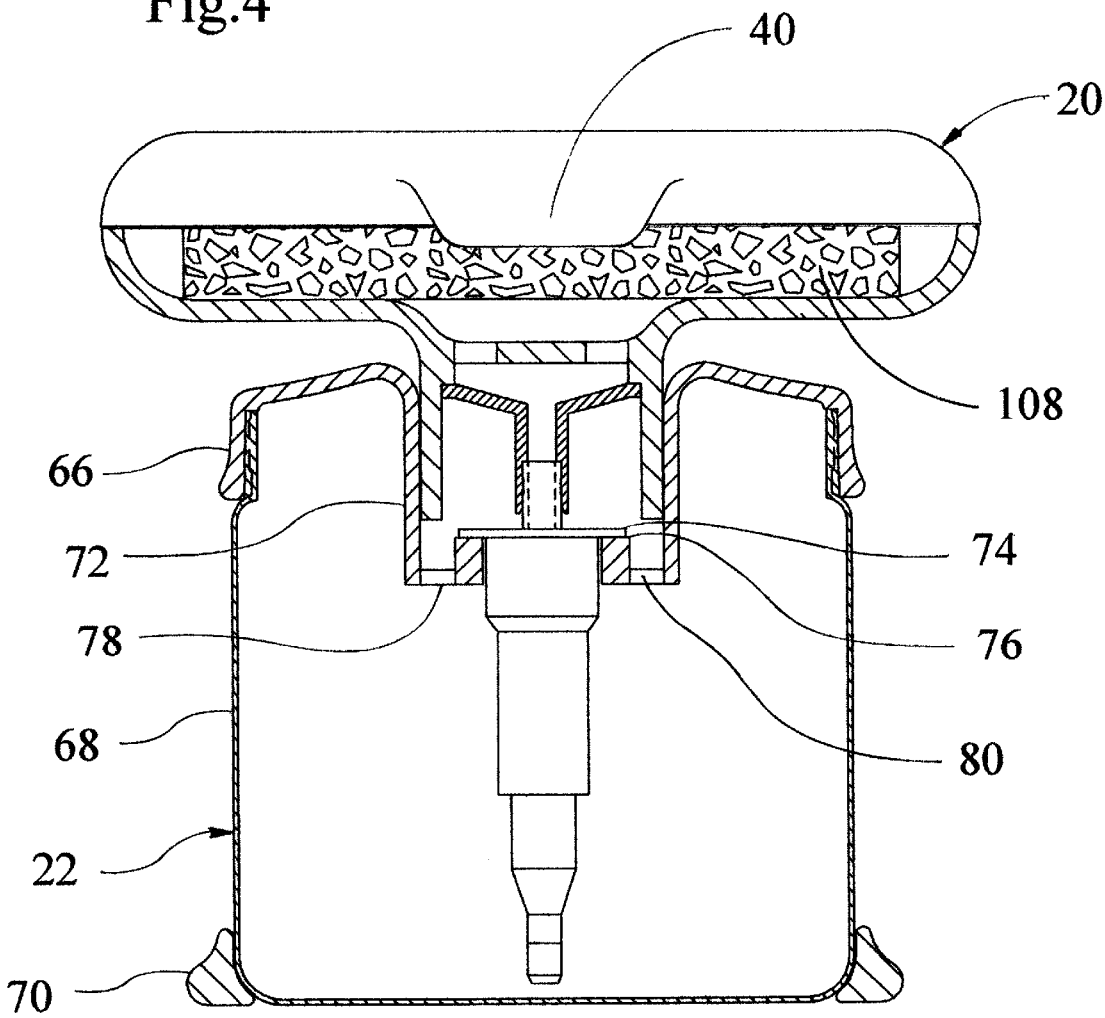
FIG. 4 is a front partially sectional view of the component modules illustrating a countertop configuration of a modular liquid dispenser and applicator of the present invention.

As depicted in FIG. 4, application module 20 may be slidably engaged and work in cooperation with countertop reservoir module 22. Countertop reservoir module 22 comprises reservoir cap 66 which may be threadably engaged to top orifice of countertop reservoir 68. Countertop reservoir 68 (preferably a common polyethylene jar) is peripherally supported at its base by elastomeric base ring 70 which is bonded to it. Reservoir cap in conjunction with countertop reservoir form an enclosed liquid reservoir with a single orifice defined by cap engagement cylinder 72. Cap engagement cylinder projects down into countertop reservoir approximately one and one quarter inches. Application module engagement cylinder 28 is sized to work in slidable cooperation with cap engagement cylinder 72. This "tube within tube" engagement does not allow off-axis cocking, however does allow vertical movement of application module 20 relative to countertop reservoir module 22. Application module may freely slide in an upward direction and disengage countertop reservoir module. Application module may freely slide in a downward direction until contact is made between liquid pump flange 74, and reservoir cap landing 76.

At this position, application module 20 is slidably engaged to countertop reservoir module 22 in an "at rest"

position. From this position, downward force applied to application module 20 is transferred through pump seal 48 to liquid pump outlet tube 56 actuating liquid pump 58. Downward motion is limited by contact between top surface of reservoir cap 66, and bottom surface of implement support tray 30. If downward force is removed, a return mechanism integral to liquid pump 58 returns application module 20 to "at rest" position.

Application module 20 may be upwardly disengaged from countertop reservoir module 22 exposing an orifice into countertop reservoir 68 defined by cap engagement cylinder 72. Facing inward at bottom of cap engagement cylinder 72, cylinder inner flange 78 supports ring shaped cap landing 76. Cylinder inner flange 78 is perforated by cap drainage slots 80.

Figure 5:
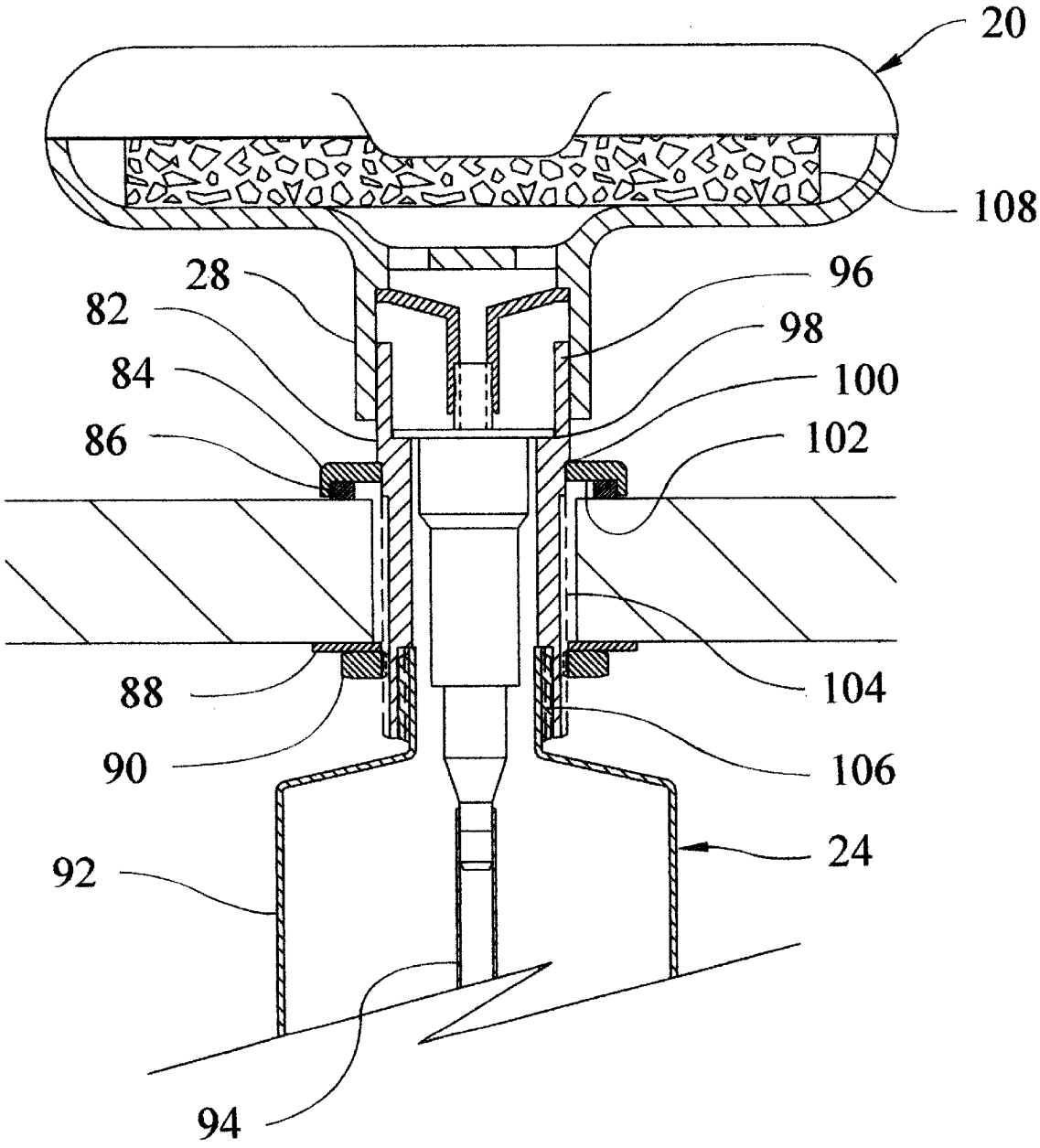
FIG. 5 is a front partially sectional view of component modules illustrating an installed configuration of a modular liquid dispenser and applicator of the present invention.

FIG. 5 depicts application module 20 as engaged to installed reservoir module 24. Installed reservoir module 24 consists of support tube 82, counter flange 84, elastomeric sealing washer 86, plain washer 88, retention nut 90, installed reservoir 92, and extension tube 94.

Application module engagement cylinder 28 is sized to work in slidable cooperation with support tube engagement cylinder 96, allowing vertical motion of application module 20 relative to installed reservoir module 24. Application module 20 may slide freely in an upward direction and disengage installed reservoir module 24. Application module 20 may slide freely in a downward direction until contact is made between liquid pump flange 74, and support tube landing 98.

At this position, application module is in an "at rest" position. From this position, downward force applied to application module 20 is transferred through pump seal 48 to actuate liquid pump 58. Downward motion is limited by contact between top face of support tube engagement cylinder 96, and bottom face of pump seal flange 52.

Application module 20 may be upwardly disengaged from installed reservoir module 24, exposing an orifice into installed reservoir 92 defined by hollow support tube 82.

Support tube undercut 100 retains counter flange 84 from upward motion. Elastomeric washer 86 is held captive within counter flange undercut 102. Plain washer 88 is maintained slidably captive to support tube 82 by retention nut 90. Retention nut 90 may be threadably engaged to support tube external threads 104. Extension tube 94 may be slidably attached to liquid pump 58. Installed reservoir 92 (preferably a common polyethylene bottle) may be threadably attached to support tube internal threads 106.

FIG. 6—Alternative Embodiments

There are various possibilities with regard to the construction and configuration of the present invention.

FIG. 6 depicts alternate application module 110, comprising cleaning brush housing 112 which is configured to store and apply liquid to a common bristled cleaning brush 124. Brush application well 114 is sized to slightly exceed the width by length dimensions of a cleaning brush. Brush application well base 116 is convoluted, with a perimeter convolution valley 118 encompasing and joining all convolution valleys. Convolution peaks 122 may support a cleaning brush, and convolution valleys 120 may act as connected troughs.

Advantages

From the description above, a number of advantages of the modular liquid dispenser and applicator of the present invention become evident:

(a) The present invention provides an easy to use device for storing a sponge, applying liquid soap to the sponge, or applying liquid soap to fingertips.

(b) Alternate reservoir modules are provided, allowing a consumer to utilize the product before committing to installation.

(c) The present invention creates an environment preferable for extending the longevity of a common kitchen sponge. Sponge remains moist, soaped, and exposed to light from all sides.

(d) The present invention claims a "footprint" of counter space not much larger than a sponge itself.

(e) Liquid is pumped vertically into a bottom fed pool eliminating gumming or clogging.

(f) Liquids of a wide viscosity range may be utilized. Liquid pump, passages and orifices are sized and configured to pump and flow liquids ranging from thin disinfectant solutions, to thicker cleansing creams.

(g) The present invention will not leak or overflow. Any leakage or failure of liquid pump results in liquid returning to reservoir.

(h) As manufactured of translucent plastic, permeation of light from all sides inhibits bacterial growth. Color of sponge and liquid soap are also visible and may be utilized to accent decor.

Operation—FIGS. 1–5—Preferred Embodiment

The present invention may be utilized as either a free standing "countertop" device, or a non-movable "installed" device depending upon customer preference. Illustrated in FIG. 4, as a countertop device, countertop reservoir module 22 rests upon a relatively horizontal planar surface (kitchen counter etc). Elastomeric base ring 70 provides a resilient, stable contact with counter. Translucent countertop reservoir 68 (preferably a wide mouth polyethylene jar) allows indication of liquid level within reservoir. Color of liquid (preferably liquid dish soap) also shows through.

Reservoir cap 66 is removably attached to countertop reservoir 68 preferably by threaded engagement. Reservoir cap in conjunction with countertop reservoir form an enclosed liquid reservoir with a single orifice defined by cap engagement cylinder 72. Cap engagement cylinder serves as an orifice through which countertop reservoir may be replenished with liquid. Liquid poured into cap engagement cylinder may enter countertop reservoir 68 through center of cap landing 76, or through cap drainage slots 80.

Cap engagement cylinder 72 may also slidably engage application module engagement cylinder 28. As engaged, application module 20 may slide up and down relative to countertop reservoir module 22. Application module may slide freely in an upward direction and disengage countertop reservoir module for replenishment of liquid as previously described. Application module may then be re-engaged and freely slide in a downward direction until contact is made between liquid pump flange 74 and reservoir cap landing 76. At this position, application module 20 is slidably engaged to countertop reservoir module 22 in an "at rest" position. From this position, downward force (fingertip pressure) applied to application module is transferred through pump seal 48 to liquid pump outlet tube 56, actuating liquid pump 58.

Therefore, pressing down on application module 20 causes further engagement to countertop reservoir module 22, and causes actuation of liquid pump 58. Length of pump seal tube 54 determines the actuation stroke length of liquid pump, and therefore the volume of liquid dispensed per actuation. This length may be predetermined in manufacturing for proper application of liquid to any particular cleaning implement. Downward motion of application module is limited by contact between top of reservoir cap 66, and bottom of implement support tray 30. As fingertip pressure is removed, a return force mechanism (spring) integral to liquid pump 58 returns application module upward to the aforementioned "at rest" position.

The aforementioned actuation of liquid pump 58, causes liquid to be drawn from countertop reservoir module and be forced upwardly through pump seal 48 into dispersion chamber 46. Pump seal is a permanently bonded component of application module 20. Liquid pumped through dispersion chamber, is dispersed and allowed to exit upwardly through multiple dispersion orifices 44 into application well 42. A check valve integral to liquid pump 58 eliminates return flow.

A bottom-fed pool of liquid (preferably liquid dishwashing soap) is therefore created in application well 42. Repeated actuation of liquid pump, by applying and releasing downward pressure on application module, will incrementally raise level of liquid pool in application well.

This shallow pool of liquid soap creates a preferential situation for dipping fingertips to wash hands.

A cleaning implement 108 (preferably a sponge) may rest flatly upon implement support tray 30 without contacting pool of liquid soap in application well 42. Fingertip pressure applied to top center of sponge will deflect it into contact with liquid soap pool. Liquid soap is therefore transferred to a sponge via contact coating and some absorption into sponge cells. Applying increased fingertip pressure activates liquid pump 58. This forces liquid soap under pressure through dispersion orifices 44, impregnating the sponge with a greater amount of soap forced deeper into its porous cellular structure.

Although a common kitchen sponge is porous and cellular, repeated pumping may completely fill sponge cells in the region of dispersion orifices, reducing the sponges ability to accept more soap. This will cause "back-pressuring" of liquid pump 58. Liquid pump (preferably a common lotion pump) is capable of vertically pumping a wide range of liquid viscosities, and an integral check valve does not allow return flow, however continual back-pressuring is undesirable and may lead to premature leakage or failure.

To avoid a back-pressuring condition, dispersion orifices 44 are located around the periphery of application well base 62 adjacent to application well fillet 64 and substantially vertical application well sidewall 60. As sponge is deflected into application well 42, deflection of sponge bottom surface is not great enough to match the contour of application well fillet 64, creating a gap between them. Excess liquid soap (that which cannot be absorbed by sponge) may flow out dispersion orifices and into this gap, eliminating excessive back-pressuring of liquid pump.

Pump seal tube 54 is configured so as to removably capture liquid pump output tube 56 preferably by snap-fit. This snap-fit attachment of liquid pump 58 to application module 20 allows for replacement of liquid pump should it ever fail. In the case of liquid pump leakage or failure, liquid soap will recede back through pump into reservoir and will not flood or overflow implement support tray 30.

Lid 32 is attached to implement support tray 30 by integral hinges 36, allowing lid to be opened and closed. Lid 32, implement support tray 30, and application well 42 combine to form cleaning implement housing 26. When lid is closed, a substantially sealed implement chamber 34 is created within cleaning implement housing.

Cleaning implement housing 26 is preferably manufactured of molded translucent plastic, allowing light to pass through it into implement chamber 34. A preferable condition for storage of a common kitchen sponge is thereby created in implement chamber 34, wherein a sponge may easily be maintained in a moist, soaped condition sealed from environmental contaminants and exposed to light from all sides.

Lid 32 may be easily opened by lifting on finger tab 40. At an open angle of approximately 120 degrees lid stop blocks 38 contact implement support tray 30 restricting farther opening.

A preferred method for application of liquid soap to a sponge is as follows:

1) lift lid
2) press down lightly on top center of sponge so as to contact bottom of sponge with liquid soap in application well
3) remove sponge and apply tap water
4) kneed sponge to a lather to determine if application of more soap is required for the particular cleaning task
5) if more soap is required, sponge may be pressed more firmly into application well, causing actuation of pump and impregnating sponge with a greater amount of soap
6) at completion of cleaning task, replace sponge on implement support tray and close lid.

Sponge is now in the (previously described) preferential situation for sponge storage.

A preferred method for applying liquid soap to fingertips is as follows:

1) lift lid
2) lift sponge and place in open lid, exposing pool of liquid soap in application well
3) dip fingertips in pool of liquid soap
4) if more soap is desired, press down on application well base to pump more soap into application well
5) close lid (sponge will fall back onto implement support tray as lid closes).

As depicted in FIG. 5, the present invention may also be utilized as an installed device. Installed reservoir module 24 may be mounted to a relatively horizontal planar surface (sink rim or countertop) through an existing or drilled accessory hole, wherein installed reservoir 92 is maintained below the planar surface. Most modern sinks are provided with extra accessory holes for mounting a spray attachment or a variety of liquid soap dispensers including the present invention. The common hole size is one and one quarter inch diameter. The preferred embodiment of the present invention may be installed in a hole size range of one and one eighth inches to one and one half inches.

Installation procedure is as follows:

1) insert elastomeric washer 86 into undercut in counter flange 84
2) slide counter flange over support tube external threads 104 (elastomeric washer facing direction of entry) until movement is restricted as counter flange contacts support tube undercut 100
3) insert support tube 82 (threaded end first) downward through hole in sink rim until elastomeric washer contacts sink rim
4) from below sink, slide plain washer 88 over protruding support tube external threads 5) threadably engage retention nut 90 to support tube external threads until sink rim is very lightly compressed between counter flange/elastomeric washer and plain washer/retention nut 6) check position of counter flange and elastomeric washer to ensure elastomeric washer covers entire perimeter of hole through sink rim 7) tighten retention nut so as to insure support tube is firmly secured to sink rim. Elastomeric washer will be compressed against top surface of sink rim to insure no surface water will permeate through hole in sink rim 8) threadably engage installed reservoir 92 to support tube internal threads 106 until hand tight 9) from above, pour liquid soap through support tube into installed reservoir until level reaches bottom of support tube 10) push end of extension tube 94 over nipple on liquid pump 58

11) slidably engage application module 20 to installed reservoir module 24 wherein extension tube inserts through support tube, and support tube engagement cylinder 96 is slidably received by application module engagement cylinder 28. Engagement is complete when liquid pump flange 74 contacts support tube landing 98. At this position, application module is slidably engaged to installed reservoir module in an "at rest" position 12) operational procedure is now identical to that of countertop embodiment, with the exception that downward motion of application module relative to installed reservoir module is limited by contact between bottom of pump seal flange 52, and top of support tube engagement cylinder 96.

Operation—FIG. 6—Alternative Embodiment

The present invention may be alternately configured to store and apply liquid soap to a bristled cleaning brush. Alternate application module 110 comprises brush housing 112, which is configured to house a cleaning brush 124 and allow clearance for its removal and replacement. Alternate application module 110 also comprises brush application well 114 which is sized to receive the full bristled surface of a cleaning brush.

Alternate application module functions largely in the same manor as the preferred embodiment, wherein downward pressure may activate liquid pump 58 causing soap to be pumped upwardly into bottom of brush application well 114. Brush application well base 116 is convoluted, wherein liquid soap may be incrementally pumped to fill convolution valleys 120 to desired level. Convolution peaks 122 project to the top of brush application well 114 and provide support for a cleaning brush 124 (placed bristles down) in an "at rest" position.

When light downward pressure is applied to top of cleaning brush 124, bristle ends may deflect around convolution peaks and be forced into liquid soap contained in convolution valleys 120. Bristle ends are thus coated with liquid soap. If application of more soap is desired, increased downward pressure may be applied to actuate liquid pump. Actuating liquid pump raises level of soap in convolution valleys, thus applying more soap further into brush bristles.

Conclusion, Ramifications, and Scope

As is apparent from the entire foregoing discussion, the modular liquid dispenser and applicator of the present invention provides a preferable device for storage and application of liquid to a cleaning implement.

Furthermore, the modular liquid dispenser and applicator of the present invention has additional advantages in that:

- it requires no special applicator, a common kitchen sponge is preferred.
- it is easily operable to either lightly coat, or deeply impregnate a cleaning implement with liquid.
- it is modular in construction wherein an application module may be used with either a countertop, or an installed reservoir module. A consumer may use the present invention as a countertop device, and then decide whether or not to invest the labor (and/or money) for permanent installation.
- it creates a shallow bottom-fed pool of liquid, which is also ideal for dipping fingertips to wash hands.
- it pumps liquid vertically, wherein all passageways and orifices are continuously liquid filled. Liquid will not gum-up and clog passageways because it is not exposed to air. Liquid is also forced through orifices under pressure, eliminating clogging.
- it dispenses and applies liquids of a wide viscosity range in a per-stroke dosage. Dosage is optimized in manufacturing for application to a particular cleaning implement.
- it is easily refillable, simply lift application module and pour in liquid.
- it claims a small "footprint" of counter space, not much larger than a sponge itself.
- in its preferred embodiment, it is manufactured of translucent plastic allowing light to shine in, and color of sponge and soap to show through. It functions as an accent piece while inhibiting bacterial growth.
- its method of application reduces liquid pump back-pressuring, extending pump life.

Although the description above contains many specific details, these should not be construed as limiting the scope of the present invention but as merely providing illustrations of some of the preferred embodiments of this invention.

For example, alternate application modules may be configured to store and apply liquid to a variety of implements, or simply to create a liquid pool. Application module and countertop reservoir modules may be configured and manufactured of materials to match any style. Clips or other methods of selective retention may be incorporated to removably retain an implement to application module lid or implement support tray.

Accordingly, the scope of the invention should be determined not by the embodiments illustrated, but by the appended claims and their legal equivalents.

Having described my invention, what I claim as new and desire to secure by Letters Patent is:

1. A modular device for dispensing liquid comprising:

an application module, configured with means to dispense liquid, and all configured with means to slidably engage a countertop reservoir module or slidably engage an installed reservoir module a fillable countertop reservoir module, capable of resting upon a substantially horizontal planar surface, and a fillable installed reservoir module, capable of mounting to a planar surface through a hole in the surface, whereby the installed reservoir may be maintained below the surface plane.

2. A modular device for dispensing and applying liquid to a cleaning implement comprising:

a first fillable reservoir a cap, supported by and configured to fit removably on said first fillable reservoir, said cap also providing means for slidable engagement a second fillable reservoir a tube, providing threaded means to removably secure and suspend said second fillable reservoir, said tube also providing means for slidable engagement a securing means, including a nut or a clip providing means for securing the tube to a planar surface, wherein the tube projects through a hole in the planar surface an application module, configured to provide means for slidable engagement to said cap or said tube, said application module also including an implement support tray capable of supporting a cleaning implement, the support tray comprising a depressed application well a liquid pump, providing means to deliver liquid from said first fillable reservoir or said second fillable reservoir to said depressed application well.

3. The device of claim 2, wherein the said means for slidable engagement to said cap or said tube further includes an application module engagement cylinder sized to work in slidable cooperation with either a cap engagement cylinder or a tube engagement cylinder allowing vertical movement without cocking of said application module relative to either a countertop reservoir module or an installed reservoir module.

4. The device of claim 3 wherein downward force exerted upon said application module causes actuation of said liquid pump.

5. The device of claim 4 wherein actuation of said liquid pump causes liquid to be drawn from said first reservoir module or said second reservoir module and be forced upwardly through a pump seal into a dispersion chamber wherein the liquid is upwardly dispersed through multiple dispersion orifices into said depressed application well creating a bottom fed pool of liquid in the application well.

6. The device of claim 5 wherein said multiple dispersion orifices transgress between said dispersion chamber and said depressed application well, the orifices positioned so as to not allow direct linear liquid flow from said pump seal through said dispersion chamber.

7. The device of claim 6 wherein said liquid pump, pump seal, dispersion chamber, and multiple dispersion orifices are sized and configured so as to allow vertical pump forced flow of liquids ranging in viscosity from approximately one to ten thousand centipoises, and wherein all passageways and orifices are continuously liquid filled eliminating gumming or clogging.

8. The device of claim 7, wherein said pump seal further comprises a pump seal tube configured so as to removably retain an output tube of said liquid pump, and wherein the length of said pump seal tube determines the actuation stroke length of said liquid pump, and therefore the volume of liquid dispensed per actuation.

9. The device of claim 8, wherein said depressed application well comprising dispersion orifices around its perimeter, also comprises an application well fillet located between an application well base and an application well sidewall, wherein as a cleaning implement resting upon said implement support tray is deflected into said depressed application well, deflection of the cleaning implement bottom surface is not great enough to match the contour of said application well fillet creating a gap between them, whereby liquid soap which can not be absorbed by said cleaning implement may flow out dispersion orifices and into this gap, eliminating excessive back pressuring of said liquid pump and thereby extending pump life.

10. The device of claim 2, including an openable lid, the lid configured fo hinged attachment to said implement support tray, the lid and support tray forming a substantially sealable cleaning implement housing.

11. The device of claim 10, wherein said openable lid further comprises protruding lid stop blocks which restrict opening of the lid to approximately one hundred twenty degrees allowing access to said cleaning implement supported on said implement support tray, said openable lid further including a protruding finger tab allowing the lid to be easily opened.

12. The device of claim 10, wherein the cleaning implement housing is manufactured of translucent plastic material allowing light to pass through it into a cleaning implement chamber, the chamber creating a preferable condition for storage of said cleaning implement which is maintained in a moist, soaped condition substantially sealed from environmental contaminants and exposed to light from all sides inhibiting bacterial growth.

13. The device of claim 2, wherein said planar surface further includes a sink rim, a kitchen counter, and a bathroom counter.

14. The device of claim 13, wherein said first fillable reservoir includes a polyethylene jar configured for threaded or snap engagement to said cap.

15. The device of claim 14, wherein said second fillable reservoir includes a polyethylene bottle configured for threaded engagement to said tube.

16. A method for dispensing and applying a liquid to a cleaning implement, the method comprising:

providing the device of claim 2, including liquid in the fillable reservoir, and said cleaning implement supported on said implement support tray; and exerting downward pressure on said application module causing actuation of said liquid pump whereby liquid is dispensed into said depressed application well; and opening said openable lid; and applying light downward pressure to said cleaning implement, deflecting the implement to contact the liquid in said depressed application well, thereby contact coating the implement with the liquid; and, if the implement requires additional liquid, applying further downward pressure to the implement causing actuation of said liquid pump, thereby forcedly impregnating said cleaning implement with the liquid.

17. The method of claim 16, wherein said cleaning implement further includes a sponge or a brush capable of resting flatly on said implement support tray, and wherein at least a bottom face of said cleaning implement is capable of being deflected by exertion of downward force on a top face of said cleaning implement.

18. The method of claim 16, wherein repeated actuation of said liquid pump by exerting and releasing downward force on said application module will incrementally raise the level of a bottom fed liquid pool in said application well, creating a preferential situation for dipping fingertips in the liquid pool.

* * * * *